United States Patent [19]

Post et al.

[11] Patent Number: 4,869,150

[45] Date of Patent: Sep. 26, 1989

[54] DEVICE FOR FORWARD ORIENTED CASE EJECTION IN AN EXTERNALLY DRIVEN AUTOMATIC CANNON

[75] Inventors: Lothar Post, Dusseldorf; Bernhard Schneider, Niederkruchten; Horst Menges, Ratingen, all of Fed. Rep. of Germany

[73] Assignee: Rheinmetall GmbH, Düsseldorf, Fed. Rep. of Germany

[21] Appl. No.: 237,672

[22] Filed: Aug. 26, 1988

[30] Foreign Application Priority Data

Aug. 28, 1987 [DE] Fed. Rep. of Germany ..... 3727740

[51] Int. Cl.[4] ..... F41D 10/32; F41F 9/06

[52] U.S. Cl. ..... 89/11; 89/33.01; 89/33.04

[58] Field of Search ..... 89/11, 33.01, 33.04

[56] References Cited

U.S. PATENT DOCUMENTS

| | | | |
|---|---|---|---|
| 3,894,471 | 7/1975 | Jayne et al. | 89/33.01 |
| 4,269,108 | 5/1981 | Stoner | 89/33.01 |
| 4,612,843 | 9/1986 | Marcon et al. | 89/33.04 |
| 4,700,608 | 10/1987 | DeHinga et al. | 89/11 |
| 4,708,049 | 11/1987 | Durant et al. | 89/11 |

*Primary Examiner*—David H. Brown

*Attorney, Agent, or Firm*—Spencer & Frank

[57] ABSTRACT

A device performs forwardly oriented case ejection from an externally driven automatic cannon, the cannon having a chamber, a breechblock which is longitudinally movable along a path by the action of a rotating control cylinder and which simultaneously advances an ejecting device for ejecting a cartridge case, and an intermittently rotating rotor having a plurality of rotor pockets disposed circumferentially thereabout for moving a cartridge into the path of the breechblock and for removing a cartridge case from the path of the breechblock, wherein the ejecting device is a case pusher for ejecting empty cartridge cases, the case pusher being coaxially mounted within the rotor for longitudinal movement relative thereto, the case pusher including a plurality of carrier elements projecting radially into respective ones of the rotor pockets; and a connecting arrangement is used for joining the case pusher with the breechblock such that the case pusher is axially displaceable together with the breechblock and the case pusher intermittently rotates with the rotor.

17 Claims, 8 Drawing Sheets

DEVICE FOR FORWARD ORIENTED CASE EJECTION IN AN EXTERNALLY DRIVEN AUTOMATIC CANNON

BACKGROUND OF THE INVENTION

The present invention relates to a device for forwardly oriented case ejection in an externally driven automatic cannon, the device including a breechblock movable in a longitudinally displaceable manner by a continuously rotating control cylinder. The breechblock advances a means for supplying a cartridge to a chamber of the cannon. Empty cartridge cases are ejected from the cannon. For this supplying and ejecting process, an intermittently rotating rotor is provided having pockets which are adapted to receive the cartridges. The pockets are circumferentially disposed about the rotor.

Such an automatic cannon is disclosed in U.S. Pat. No. 4,612,843, wherein ejection levers are the means provided for ejecting the empty cartridge cases. The ejection levers extend on both sides of an outer region of the rotor into left and right laterally adjacent pockets of the rotor and are fixed to the breechblock. These ejection levers selectively eject the empty cases toward the front of the cannon from either the left rotor pocket or from the right rotor pocket depending on the direction from which the cartridges are supplied. A disadvantage of this arrangement is that the forces acting on the lever during ejection of the case are fully transferred by the lever arrangement directly to the breechblock, thereby subjecting the point of connection between the lever and the breechblock to an undesirable combination of torsonal and shearing stresses. In particular, this combination of stresses on these long levers, which are additionally bent at an angle in the region of the rotor pockets thereby incurring additional stress, can have a negative impact on the readiness of the breechblock.

In this arrangement, the ejection levers and the breechblock are made of one piece, requiring considerable expenditures for their manufacture. Additional stresses may occur at the points of connection thereof due to notch stress effects which may cause a premature breakdown of the entire breechblock. Moreover, in this prior art arrangement, in ejecting an empty case, it is necessary to guide the empty case longitudinally by means of an additional component, for example a pivotally movable partition wall. This requires an additional drive means to pivot this partition wall to the respective left or right ejector pocket of the rotor.

SUMMARY OF THE INVENTION

It is an object of the present invention to provide a stable and non-complex device for the forward ejection of empty cartridge cases in an externally driven automatic cannon, with such device ensuring a relatively high level of readiness and avoiding additional adverse stress effects on the breechblock.

The above and other objects are accomplished according to the invention by the provision of a device for forwardly oriented case ejection from an externally driven automatic cannon, the cannon having a chamber, a breechblock which is longitudinally movable along a path by the action of a rotating control cylinder and which simultaneously advances an ejecting device for ejecting a cartridge case, and an intermittently rotating rotor having a plurality of rotor pockets disposed circumferentially thereabout for moving a cartridge into the path of the breechblock and for removing a cartridge case from the path of the breechblock, wherein (a) the ejecting device is a case pusher for ejecting empty cartridge cases, the case pusher being coaxially mounted within the rotor for longitudinal movement relative thereto, the case pusher including a plurality of carrier elements projecting radially into respective ones of the rotor pockets; and (b) a connecting arrangement for joining the case pusher with the breechblock such that the case pusher is axially displaceable together with the breechblock and the case pusher intermittently rotates with the rotor.

A bearing is provided for movably mounting the case pusher on a support shaft, so as to facilitate longitudinal displacement of the case pusher within the interior of the rotor, so that the case pusher is independent of the breechblock. The case pusher can therefore separately absorb, in an advantageous manner, torsional and shear stresses which occur during the ejection of the case. Carrier elements are disposed on the case pusher and project radially into the rotor pocket. Additionally, a form-locking connection is provided between the case pusher and the breechblock. Compared to the prior art fixed interconnection of the case pusher and the breechblock, this type of joint transmits forces only in an axial direction relative to the path traveled by the breechblock, such that the stresses acting on the breechblock during the ejection process are reduced considerably. By mounting the case pusher within the rotor, no bending or torsional stresses are transferred to the breechblock which would endanger its readiness, and instead only such thrust forces as are required to perform the longitudinal displacement of the cartridge and the case pusher are transferred to the breechblock. Thus, this type of form-locking connection also serves to avoid notch stress effects which would have an adverse effect on the service life of the breechblock.

The case pusher is mounted on a rotor drive shaft which is disposed within the rotor. Thus it is further possible, in an advantageous manner, to make the carrier elements of the case pusher relatively short. This produces favorable leverage ratios and the resulting low bending stresses are reliably absorbed by a tubular bearing housing of the case pusher, and these bending stresses are transmitted to the shaft over a relatively large surface area.

A slide bearing or ball bearing is disposed within the bearing housing of the case pusher to ensure, in a further advantageous feature of the invention, low frictional forces between the case pusher and the drive shaft during longitudinal displacement of the case pusher along the drive shaft.

According to a further feature of the invention, the carrier element includes a carrier element surface which has a curved cross section for pushing out the cases. This carrier element surface permits the carrier element to contact the case across a relatively large surface area during an ejecting operation, thereby avoiding deformation of the carrier element surface due to stress concentrations which could result from uneven surface pressures.

According to a further feature of the invention, the form-locking connection between the case pusher and the breechblock is composed of a curved carrier spring which is received within a groove in the breechblock, the groove being adapted to conform to the shape of the carrier spring, thereby permitting the transfer of the forces required to longitudinally displace the case pusher to be distributed across a relatively large surface area, so that these forces produce only relatively low stresses which can be transmitted to the breechblock so that it will enjoy a relatively long service life. A plurality of carrier springs are distributed about the circumference of the tubular bearing.

The width of the groove and the width of the carrier spring are each respectively greater than the width of gaps which exist between adjacent carrier springs, thereby ensuring constant engagement of at least one carrier spring within the groove and which therefore always constrain the case pusher to follow the axial position of the breechblock.

Longitudinal slits are disposed in the rotor so as to form respective openings which communicate between each pocket and an axially extending bore within the rotor, this bore being adapted to slideably receive the bearing housing. The carrier elements are connected to the bearing housing by respective carrier webs which extend through the respective slits in the rotor. Without the necessity of any additional drive means, these longitudinal slits engage the respective webs to thereby ensure simultaneous rotary movement of the case pusher together with the rotor.

To provide for reliable transfer of the forces acting on the case pusher to the weapon housing via the breechblock during the ejection process, two pairs of guide rollers are disposed on the breechblock, preferably in the front and rear regions of the breechblock. These rollers are mounted for rolling within prism-shaped guides which are disposed on both sides of the breechblock. These prism-shaped guides can be adjusted by means of adjustable setting members to permit longitudinal displacement of the breechblock along the guides with virtually no play therebetween. This ensures a precise forward and return movement of the breechblock, with the arrangement of the rollers at the front and at the rear reducing to a minimum the degrees of freedom of motion of the breechblock. The arrangement of the rollers permits absorption by the case pusher of forces generated by the impact of shell ejection in a relatively low-stress manner.

In a further advantageous feature of the invention, an insertion lever for controlling the supply of cartridges is configured so that its rear profile serves as an outer delimiting wall of one of the rotor pockets during the case ejection process, so that additional guide members are unnecessary and can be omitted.

Each pocket serves as a case chute when disposed at a predetermined one of the static positions thereof, and has an associated ejection chute for the positive forward ejection of the cases. The ejection path of a selected one of the ejection chutes is kept open between the rotor and the ejection chute by means of a slide which simultaneously blocks off the ejection chute from the adjacent rotor pocket serving to supply the cartridges, and thereby permits selective cartridge loading via either one of the two uppermost ones of the rotor pockets.

The invention further advantageously permits the manufacture of the case pusher as a cast component essentially without chip cutting work and requiring only minimal mechanical processing operations. By arranging the case pusher within the rotor, greater space utilization is realized without a corresponding increase in weight.

The invention will be described in greater detail below with reference to an embodiment that is illustrated in the drawings.

DESCRIPTION OF THE PREFERRED EMBODIMENTS

Figure 1:
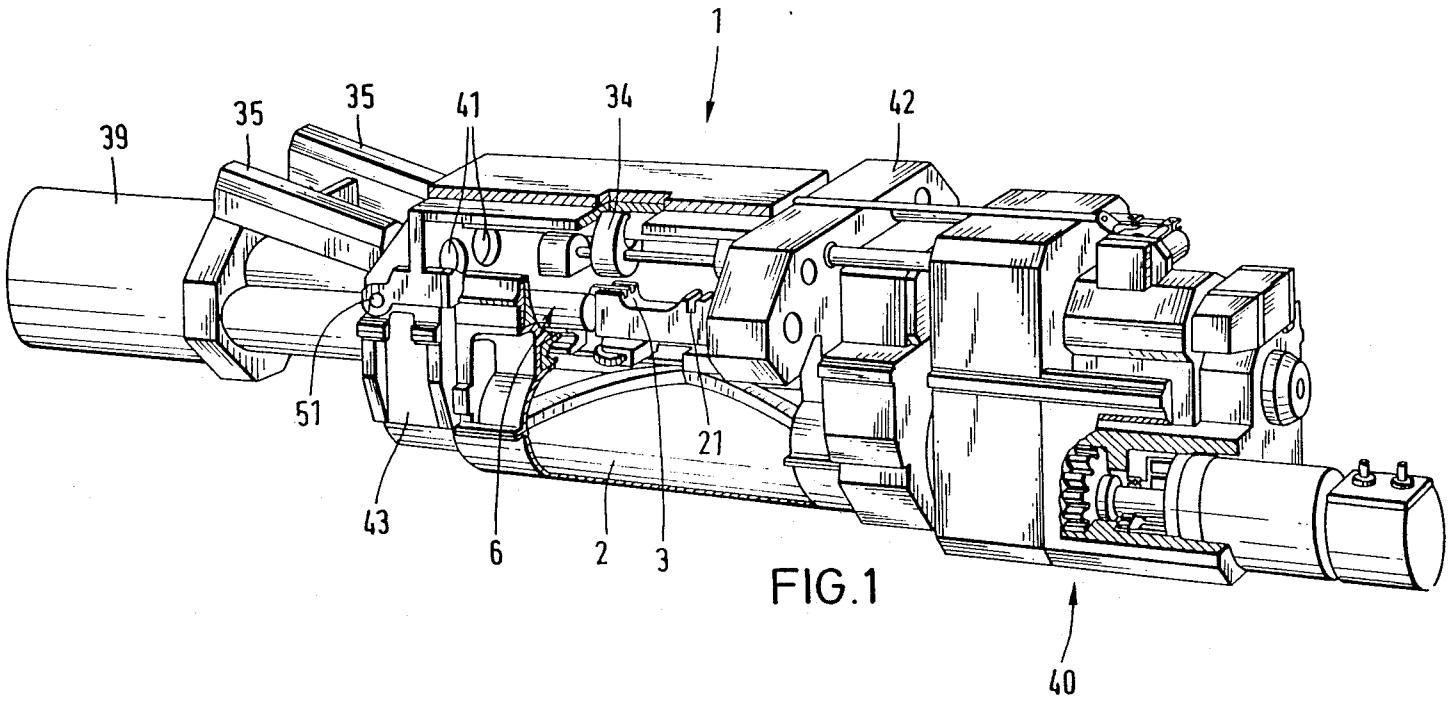
FIG. 1 is a perspective view, partially broken away, of an automatic cannon in accordance with the invention.

FIG. 1 illustrates the structure of an externally driven automatic cannon 1 having a breechblock 3 which is longitudinally movable by means of a continuously rotating control cylinder 2. The breechblock 3 serves not only to supply cartridges 6 into a chamber 46 (seen in FIG. 2) of a gun barrel 39 but also, by means of ejection mechanisms discussed further hereunder and shown in detail in FIGS. 2 to 10, to push empty cartridge cases 7 toward the front of the cannon 1. The cartridge cases 7 are selectively ejected from either a left or a right ejection chute 35 disposed respectively on the left and the right sides of the gun barrel 39.

Figure 8:
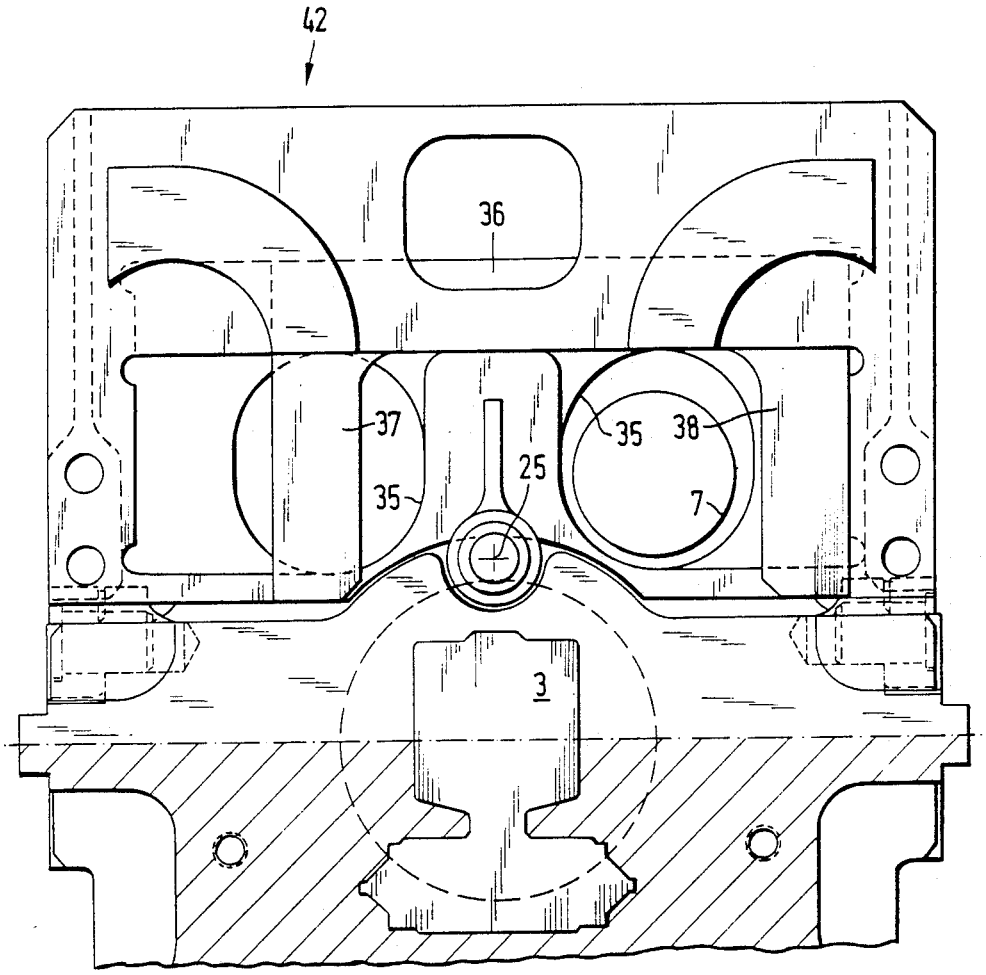
FIG. 8 is a cross-sectional view seen along line VIII—VIII of FIG. 2 showing the slide and ejection chutes in relation to the rotor.
Figure 9:
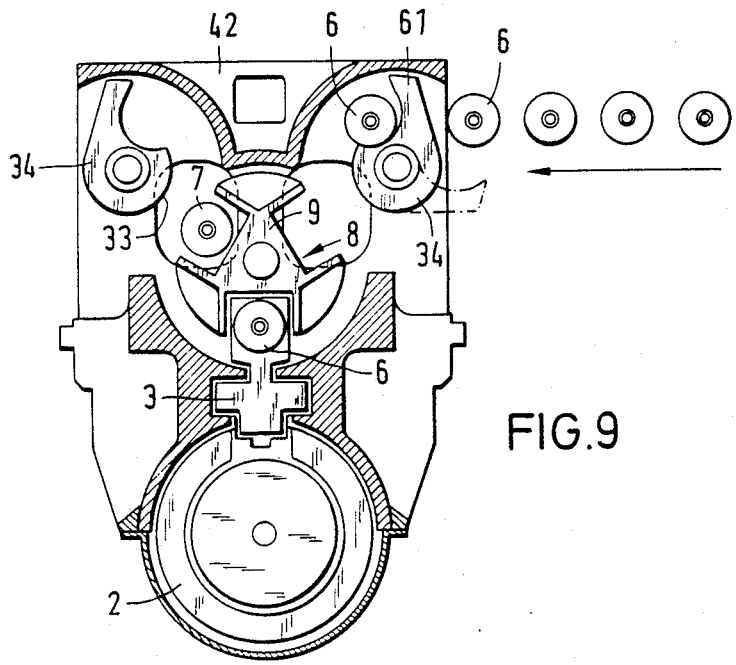
FIGS. 9 and 10 are schematic cross-sectional representations, in simplified form for clarity, as seen along line IX—IX of FIG. 2 for different directions of cartridge loading and case ejection.
Figure 10:
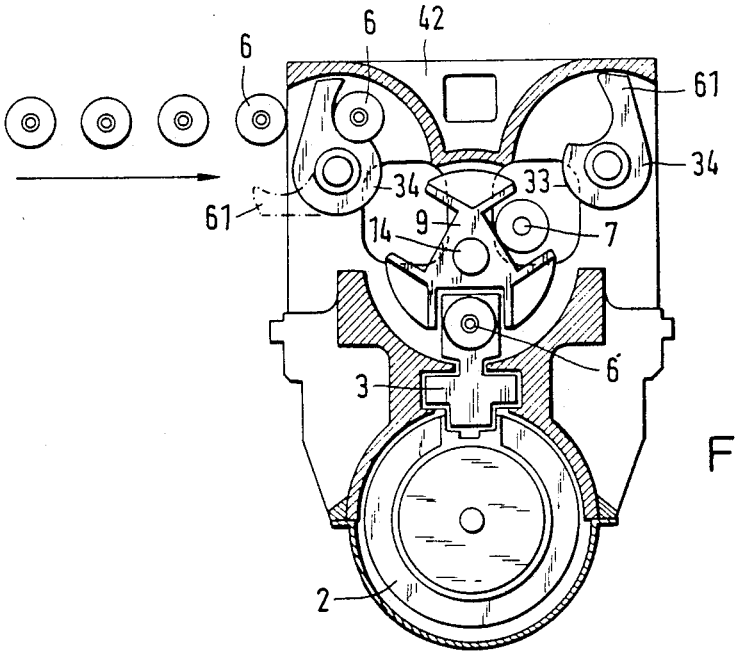

A drive and gear unit 40 is disposed at a rear end of the automatic cannon 1, and includes a drive for the control cylinder 2, a stepping gear for intermittently advancing a rotor 9, another continuously rotating drive assembly for driving a respective one of two insertion levers 34 for the controlled supply of cartridges 6, and a change gear for changing the cartridge supply direction to permit the cartridges 6 to be selectively supplied either from the right or the left of the gun barrel 39 as schematically shown in FIGS. 9 and 10. The drive and gear unit 40 also includes a drive for causing a slide 36, as shown in FIG. 8, to occupy one of two positions so as to release only that one of a pair of case ejection windows 41 which faces away from the respective side of the rotor 9 from which the cartridges 6 are supplied.

A weapon housing 42 includes, in a lower frontal region, a breechblock locking mechanism 43 which, like the driving and gear unit 40, do not form a part of the teachings of the present invention, but which are within the ambit of one skilled in the arts to which the present invention pertains.

The two ejection chutes 35 are preferably oriented toward the front with a minimum elevation, and the ejection chutes 35 preferably also permit ejection of the empty cartridge cases 7 through an armored turret aperture (not shown).

Figure 2:
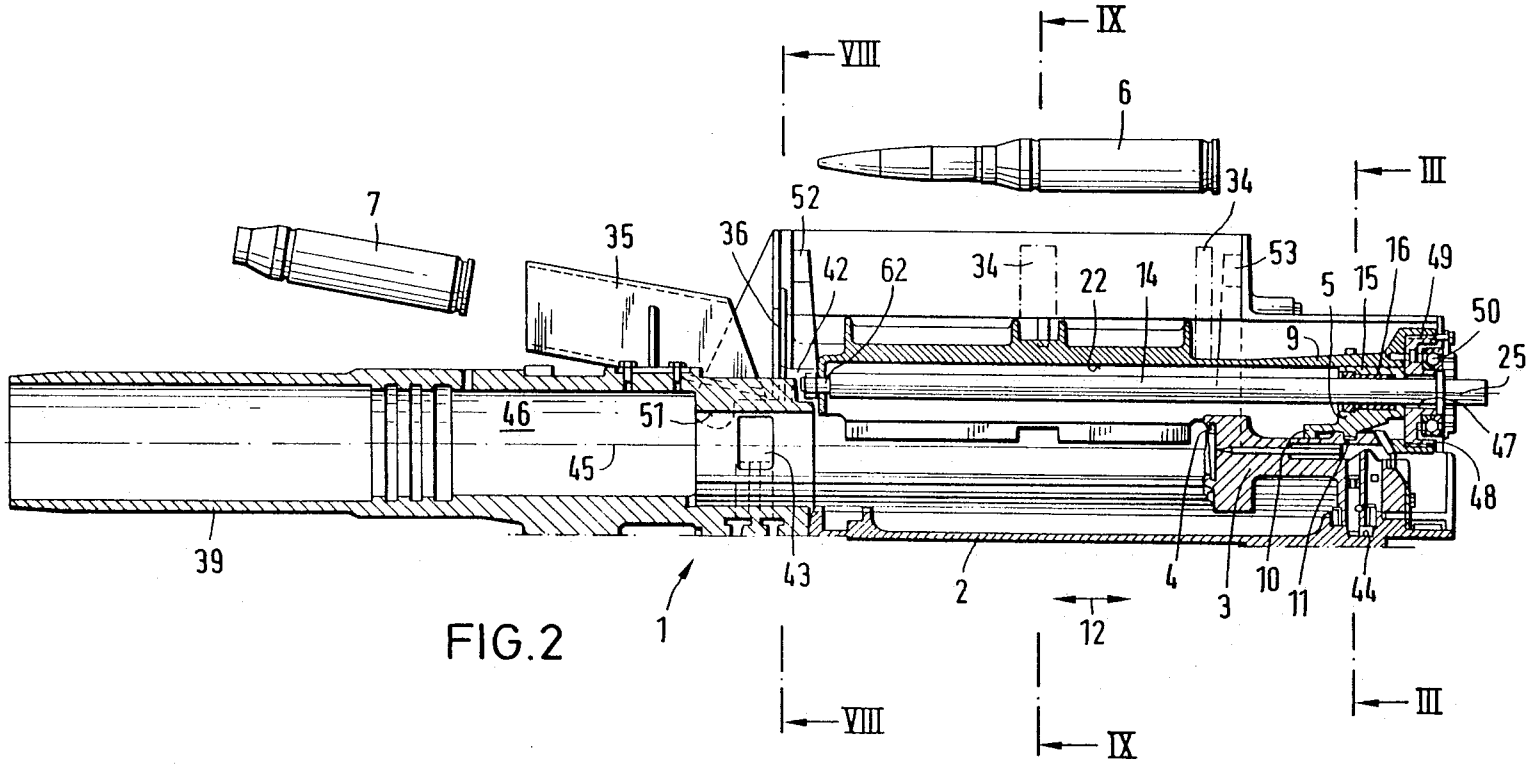
FIG. 2 is a cross-sectional side view of a gun barrel, a breechblock, a rotor, and a case ejection device.

FIG. 2 illustrates in detail the configuration of the mechanisms employed to eject the empty cartridge cases 7. The breechblock 3 is movable in a known manner by means of a control groove 44 in the control cylinder 2 so as to travel in a path which is parallel to a bore axis 45 of the gun barrel 39. The breechblock 3 includes a means 4 for receiving the cartridges 6 for transporting them into and out of the chamber 46 of the gun barrel 39. The breechblock 3 is able to simultaneously push a means 5, configured as a case pusher 5, to eject empty cases 7 toward the front of the cannon 1.

The control groove 44 of the control cylinder 2 is configured in such a manner that the breechblock 3 comes to a stop in a front detent position and a rear end position within the housing 42. In the front detent position, the breechblock 3 is locked by the breechblock locking mechanism 43, after which the cartridge 6 is fired and the breechblock 3 is unlocked. On withdrawal of the breechblock 3, the path of movement of the cartridge case 7, which is held by the means 4, is colinear with the bore axis 45 of the gun barrel 39 so that it is ensured that the cartridges 6 are supplied, and the cases 7 are removed, in a straight line.

The rotor 9 has a rotor axis 25 which is disposed in a plane 24. The plane 24 passes through the rotor axis 25, a control cylinder axis 26 (seen in FIG. 3) of the control cylinder 2, and the bore axis of the gun barrel. The rotor 9 is provided with three pockets 8 (seen in FIG. 3) which are uniformly angularly spaced about the rotor axis 25. One of the pockets 8 is disposed in the plane 24, having a position which is located along the bore axis 45. This pocket 8 thus can transfer a cartridge 6 to the breechblock 3 or receive an empty case 7 for transporting it away from the breechblock 3.

During the stopping of the breechblock 3 at its rear end position, the stepping gear advances the rotor 9 by one step such that the rotor 9 moves the empty cartridge case 7 out of the breechblock 3 and simultaneously moves the next cartridge 6, which is to be fired, via the next pocket 8 into the breechblock 3.

Within the rotor 9, the case pusher 5 is mounted coaxially and is displaceable longitudinally relative to the rotor 9. The case pusher 5 is equipped with a plurality of carrier elements 10 which respectively project radially into each respective rotor pocket 8. By way of a form-locking connection 11, which in the preferred embodiment is a tongue and groove joint, the case pusher 5 is connected with the breechblock 3 in such a manner that, on the one hand, it is displaceable together with breechblock 3 in an axial direction 12 which is parallel to the bore axis 45 and, on the other hand, is able to rotate with the rotor 9 during the intermittent rotation thereof. Because of the integration of the case pusher 5 within the rotor 9 and with an appropriate longitudinal displacement of the slide 36, ejection of the case 7 from that pocket 8 which is facing away from the breechblock 3, is made possible by engagement of the case 7 by a respective one of the carrier elements 10 of the case pusher 5.

The case pusher 5 includes a generally cylindrical bearing housing 15 and is mounted coaxially about a drive shaft 14 which is disposed centrally within the rotor 9. The bearing housing 15 is not limited in configuration to cylindrical shapes, and other shapes can be used. Where other such shapes are used, the hollow interior of the rotor 9 need not be shaped to conform thereto, since the case pusher 5 is supported only by the drive shaft 14 for longitudinal movement.

A slide bearing or ball bearing 16 is provided within the bearing housing 15 to facilitate longitudinal displacement of the case pusher 5 along the drive shaft 14. The front end of the drive shaft 14 is mounted in the weapon housing 42 and its rear end is connected, in a manner not shown, with the stepping gear and, by way of a toothed shaft periphery 47, with a drive disc 48 which is fixed to the rotor 9.

The drive disc 48 is connected with the rotor 9 by a threading 49 so as to be secured against rotation relative thereto. Moreover, the drive disk 48 serves to accommodate a bearing 50 which radially and axially fixes the rotor 9 relative to the weapon housing 42. In the frontal region of the rotor 9, a shaft bearing 62 fixed to the weapon housing 42 serves to fasten the rotor 9 at its forward end. The front region of the bearing 62, which is part of the weapon housing 42, can be pivoted toward the front of the cannon about an axis 51 (seen in FIG. 1) to facilitate installation of the drive shaft 14. The rear portion of the frontal walls of the two ejection chutes 35 are sloped to enable this pivoting movement to be performed. In this frontal region of the shaft bearing 62 there is disposed the slide 36 (seen in FIG. 8) which is driven by a change gear in a manner not shown.

Figure 3:
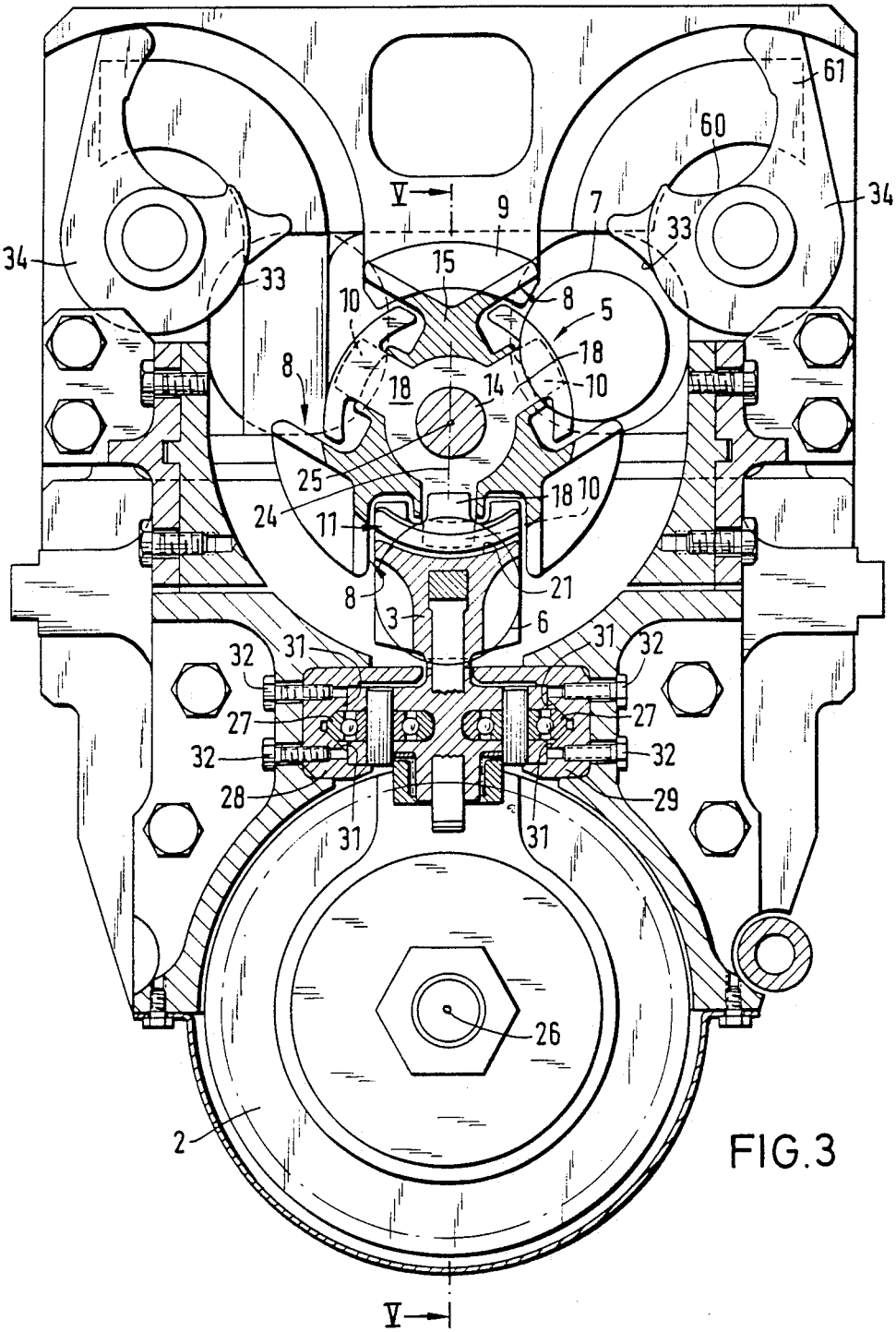
FIG. 3 is a cross-sectional view of the breechblock, the rotor and the case pusher seen along line III—III in FIG. 2.
Figure 4:
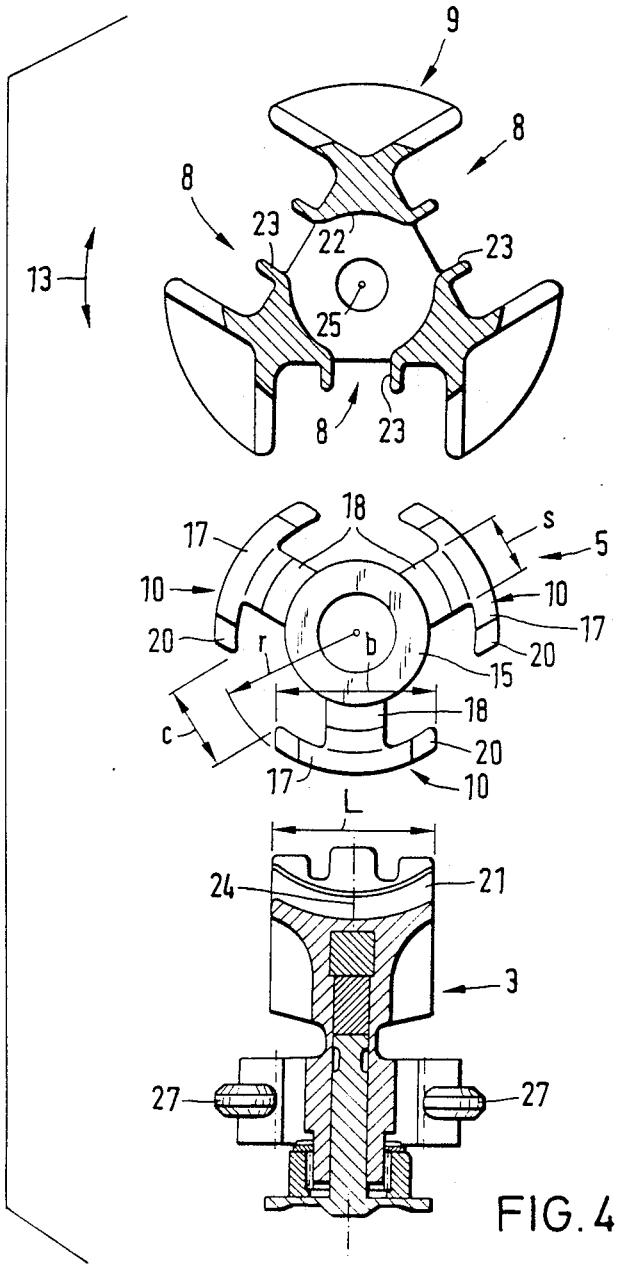
FIG. 4 is an exploded sectional view of the components shown in FIG. 3, including the rotor, the case pusher and the breechblock.
Figure 5:
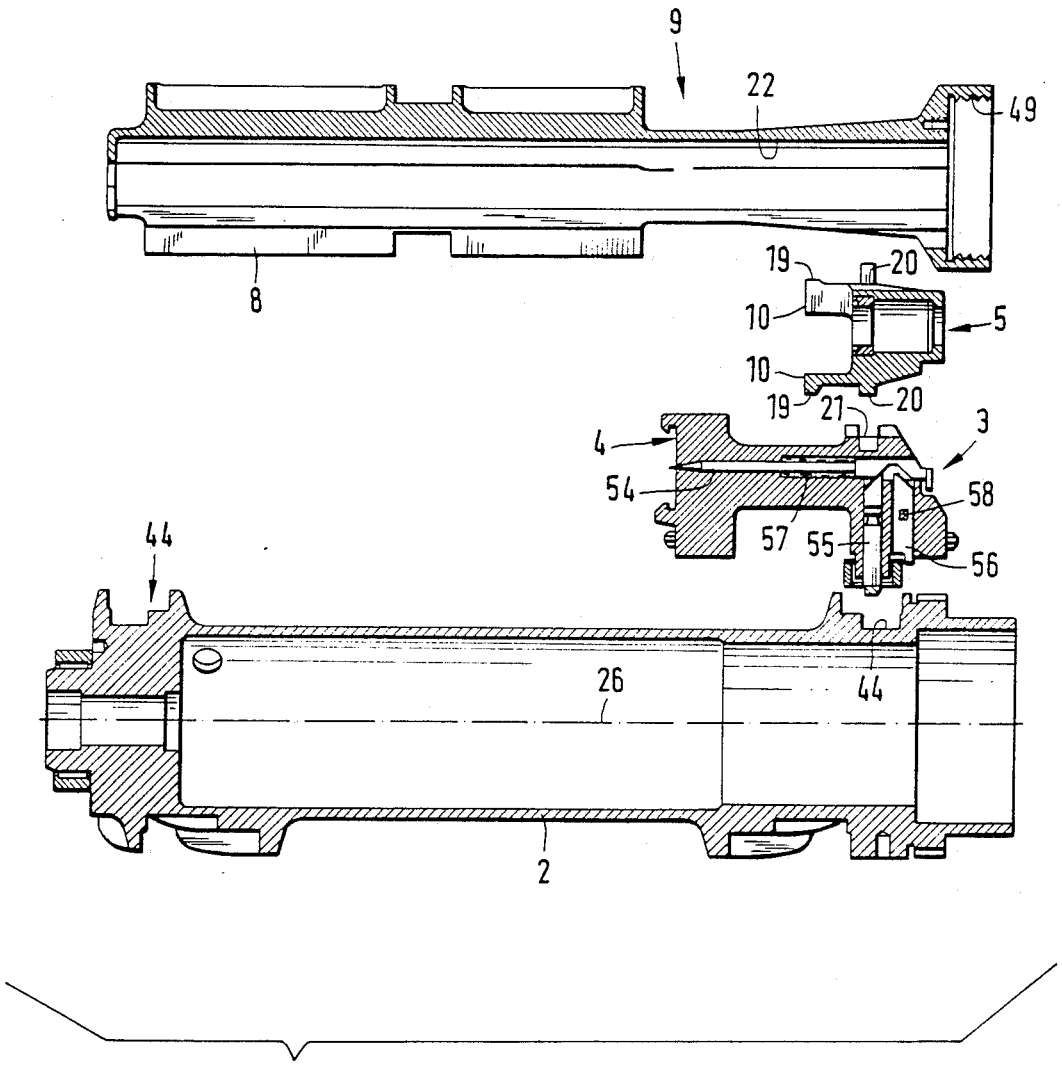
FIG. 5 is an exploded cross-sectional view seen along line V—V of FIG. 3 of the components including the rotor, the case pusher, the breechblock and the control cylinder.

To axially fix the cartridges 6 within each pocket 8, the weapon housing 42 is provided, in the region of the rotor 9, with a front guide 52 and a rear guide 53, and with insertion levers 34 (shown in dotted outline in FIG. 2) for insertion of a cartridge 6; these levers are shown individually in FIG. 3 and will be described in detail below.

To permit the longitudinal movement of the case pusher 5 within the rotor 9, the interior of the rotor 9 is provided with a longitudinal bore 22 which is delimited in the front by the frontal wall of the rotor 9 and in the rear by the drive disc 48, and is preferably adapted to conform to the outer contour of the bearing housing 15, although this is not necessary. The configuration of the case pusher 5 and its cooperation with the rotor 9 and the breechblock 3 will be described in greater detail hereunder with reference to FIGS. 3 to 7.

The rotor 9 has three pockets 8 which are offset by 120° about the rotor axis 25. In the center of each pocket 8, in the region nearest the axis 25, the carrier elements 10 of the case pusher 5 each engage in a respective one of the pockets 8. Each of the carrier elements 10 includes a front end 19 connected to a longitudinal web 18 which is in turn connected with the bearing housing 15. Each of the carrier elements 10 includes a segment-like carrier surface 17 for engagement with the case 7.

Each longitudinal web 18 includes, in its rear region, a plurality of segment-like carrier springs 20, each of which serves as a "tongue" element of the form-locking connection when it is disposed within a groove 21 in the breechblock 3. The carrier springs 20 are separated from one another by gaps having a chordal length dimension c. The respective carrier spring 20 engaged in the groove 21 in the breechblock 3 has a periphery extending at a radius r about the rotor axis 25. The carrier spring 20 extends in either of the circumferential directions 13 (indicated by the double-headed arrow in FIG. 4). The respective chord length L of the groove 21 disposed in the breechblock 3 corresponds to a chord width b of the carrier spring 20. In order to produce the form-locking connection 11, the length L and the width b are each greater than the chordal dimension c of the gaps between the carrier springs 20 of case pusher 5, so that there is always engagement of at least one carrier spring 20 in the groove 21.

To receive the webs 18 of the case pusher 5, the rotor 9 has a plurality of longitudinal slits 23 between each pocket 8 and the bore 22, with each such slit 23 being sufficiently wide to receive a thickness s of the webs 18.

Figure 6:
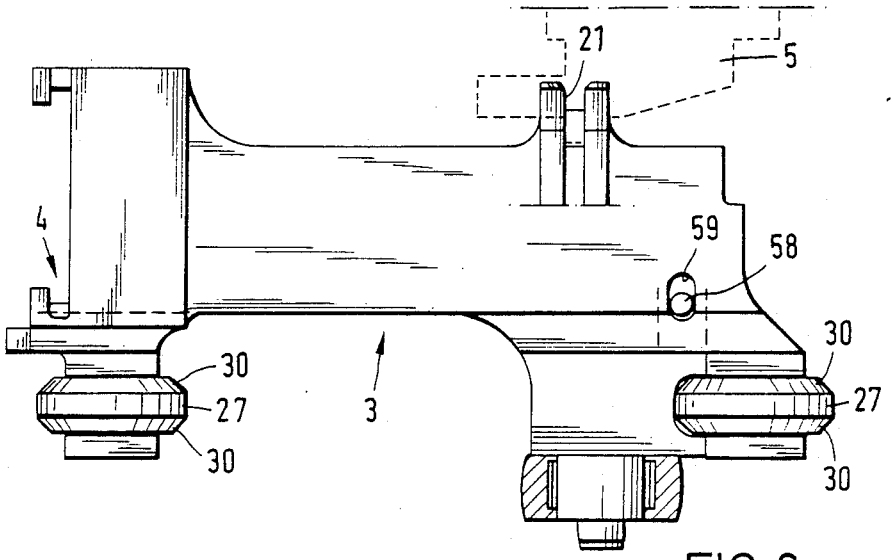
FIG. 6 is a side elevational view of the breechblock.
Figure 7:
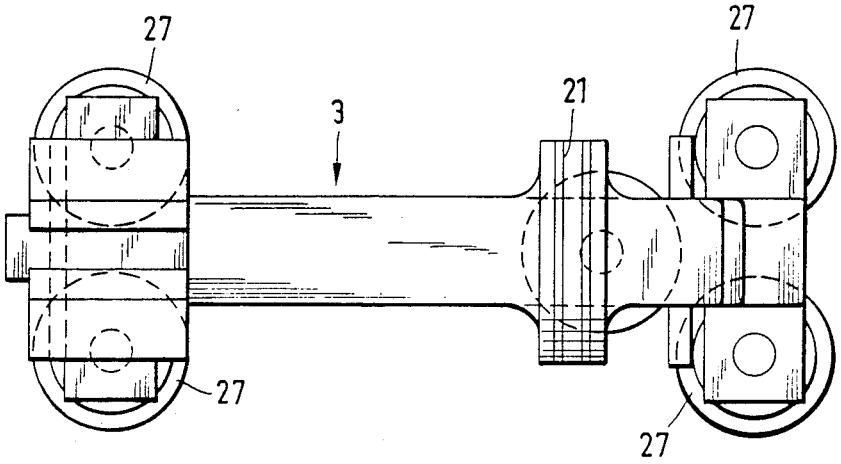
FIG. 7 is a top elevational view of the breechblock.

For precise, secure and space saving guidance of the breechblock 3 along its path of travel, the breechblock 3 is equipped with guide rollers 27 which are oriented so as to be facing outwardly from the breechblock 3 on both sides thereof, the rollers 27 being mounted in both the front and rear regions (as seen in FIGS. 6 and 7) of the breechblock 3. The front and rear guide rollers 27 on the left side are guided in a left longitudinal guide 28 (seen in FIG. 3) which is parallel to the bore axis 45 of the gun barrel 39 and is fastened in the weapon housing 42 and, correspondingly, the front and rear guide rollers 27 on the right side are guided in a right longitudinal guide 29 which extends parallel to the bore axis 45 of the gun barrel 39 and is fastened on the right side in the weapon housing 42.

The guide rollers 27 are provided with upper and lower sloped faces 30 arranged symmetrically, preferably at an angle of 45°, and the longitudinal guides 28 and 29 are provided with prismatically-shaped guide faces 31 corresponding closely to the shape of the sloped faces 30. The two longitudinal guides 28 and 29 are each equipped with adjustable setting members 32 supported at the weapon housing 42, and which can be adjusted for performing a precise adjustment of the longitudinal guides 28 and 29 in a direction which is oriented transversely to the plane 24. The setting members 32 permit setting of the longitudinal guides 28, 29 from both exterior sides of the breechblock 3. The horizontally flat arrangement of the guide rollers 27 additionally permits reliable guidance and support of the breechblock 3 by the longitudinal guides 28 and 29, and thereby (without undesirable transmission of additional forces) permits transfer of the forces generated during case ejection to the weapon housing 42. Moreover, a comparatively shorter distance is thereby realized between the rotor axis 25 and the axis 26 of the control cylinder 2, resulting in a space saving arrangement.

Furthermore, a firing pin 54 (seen in FIG. 5) is provided to ignite the cartridge 6. A control block 55, an arresting member 56, and a compression spring 57 are provided to actuate the firing pin 54, as discussed further hereunder.

A cartridge 6 is ignited with the breechblock 3 in a locked state in the forward detent position, by a cam (not shown) of the control groove 44 in the control cylinder 2. The cam displaces the control block 55 along its axial direction, thereby simultaneously displacing the firing pin 54 by way of sloped facing surfaces in the control block 55 and the firing pin 54. The firing pin is thereby displaced in the direction of the bore axis 45 of the gun barrel 39. During the rearward movement of the breechblock 3, the arresting member 56 pushes the firing pin 54 to a rearward position back via opposed sloped faces in the arresting member 56 and the firing pin 54. The arresting member 56 is actuated by a pin 58 displaced by a cam surface (not shown) of the weapon housing 42, the pin 58 being disposed within an elongated hole 59 in the breechblock 3. The firing pin 54 remains held in the rear position by the arresting member 56 until the forward movement of the breechblock 3 has reached an appropriate cam surface of the weapon housing 42 to release the arresting member 56.

Cartridges 6 are supplied to the rotor 9 and cases 7 are ejected from the rotor 9 (as seen schematically in FIGS. 9 and 10) by way of the two upper rotor pockets 8 disposed symmetrically on both sides of the plane 24, with the cartridges 6 being selectively supplied, as shown schematically in FIG. 9, from the right side of the weapon housing 42 into a right rotor pocket 8 by an insertion lever 34 likewise disposed on the right side in the weapon housing 42 while the cases 7 are ejected through a left rotor pocket 8. Conversely, as schematically shown in FIG. 10, the cartridges 6 can be supplied from the left side of the weapon housing 42 by an insertion lever 34 disposed on the left of the weapon housing 42 and the cases 7 are ejected toward the front through the right rotor pocket 8. Each insertion lever 34 has an arm 61 and a rear surface 33.

For the supply of cartridges 6, for example, during each revolution of one of the insertion levers 34, a cartridge 6 is transported into a rotor pocket 8 while the other one of the insertion levers 34 is in the rest position on the other side of the weapon housing 42, and its rear surface 33 facing the adjacent pocket 8 thereby forms an external delimiting wall for the adjacent pocket 8 of the rotor 9. The insertion lever 34 is provided with a recess 60 to enable it to move the cartridge 6, thereby enabling the arm 61 of the insertion lever 34 to carry only one of the cartridges 6 at a time while the rear surface 33 blocks the other ones of the cartridges 6 until they are to be inserted by the arm 61.

As shown in FIG. 8, the slide 36 is disposed between the ejection chutes 35 and the two upper pockets 8. The slide 36 is equipped with two laterally displaceable arms 37 and 38. In operation, one arm 38 releases a path for ejection of a case 7 into a selected one of the two ejection chutes 35 while the arm 37 blocks the passage to the other one of the ejection chutes 35 so as to form a frontal delimiting wall for a new one of the cartridges 6 which is to be introduced. When a change is made, for example, from one cartridge supply direction to the other, as shown in FIGS. 9 and 10, the slide 36 is correspondingly laterally displaced by means of a change gear (not shown) to block the previously open passage and to open the previously blocked passage.

To supply the cartridges 6 and eject the cases 7, the following operational steps are performed.

During firing, when the breechblock 3 is in a rear detent position, the stepping gear advances the rotor 9 by one step. For example, if the cartridges 6 are supplied from the left, the rotor 9 performs a counterclockwise transporting step and if the cartridges 6 are supplied from the right, the rotor 9 performs a clockwise transporting step. A case 7 is pulled out of the chamber 45 by the breechblock 3 and is then pulled via a rotor pocket 8 out of the breechblock 3. The case 7 is then pivoted into the plane of the case ejection windows 41, while simultaneously the cartridge 6 to be supplied is pivoted into a receiving position for the breechblock 3. During rotation of the rotor 9, the carrier spring 20 of the case pusher 5 is turned out of the groove 21 of the breechblock 3 and a next following carrier spring 20, which is offset by 120° from the preceding carrier spring, is moved into the groove 21. At the end of the transporting step, which is performed in a selected one of the two circumferential directions 13, the case pusher 5 is carried along toward the front of the cannon by way of the form-locking connection 11 when the breechblock 3 begins to move. The carrier face 17 of the carrier element 10, which is disposed at the case pusher 5, pushes the case 7 through the case ejection window 41 in the weapon housing 42, and then through an associated one of the ejection chutes 35.

It will be understood that the above description of the present invention is susceptible to various modifications, changes and adaptations,.and the same are intended to be comprehended within the meaning and range of equivalents of the appended claims.

What is claimed is:

1. In a device for forwardly oriented case ejection from an externally driven automatic cannon, the cannon having a breechblock which is longitudinally movable along a path by the action of a rotating control cylinder and which simultaneously advances an ejecting means for ejecting a cartridge case, and an intermittently rotating rotor means having a plurality of rotor pockets disposed circumferentially thereabout for moving a cartridge into the path of the breechblock and for removing a cartridge case from the path of the breechblock, the improvement comprising:

(a) said ejecting means being a case pusher means for ejecting empty cartridge cases, said case pusher means being coaxially mounted within said rotor means for longitudinal movement relative thereto, said case pusher means including a plurality of carrier elements projecting radially into respective ones of the rotor pockets; and (b) a connecting means for joining said case pusher means with the breechblock such that said case pusher means is axially displaceable together with said breechblock and said case pusher means intermittently rotates with said rotor means.

2. In a device as defined in claim 1, wherein one of said plurality of rotor pockets has an outer delimiting boundary which is formed by a rear contour of a cartridge insertion lever when said cartridge insertion lever is in a rest position.

3. In a device as defined in claim 1, further comprising:

a left longitudinal guide disposed axially parallel to an axis of the cannon and which is fixed to a housing of the cannon, and a right longitudinal guide disposed axially parallel to the axis of the cannon and which is fixed to the housing of the cannon; and two pairs of outwardly oriented guide rollers mounted on front and rear regions of said breechblock, each of said guide rollers in each respective one of said two pairs being disposed on opposite left and right hand sides of said breechblock, with the front and rear guide rollers of the left side of said breechblock being guided in said left longitudinal guide and with the front and rear guide rollers of the right side of said breechblock being guided in said right longitudinal guide.

4. In a device as defined in claim 3, wherein said guide rollers each have upper and lower sloped faces, and said left and right longitudinal guides have respective prismatically-shaped guide faces corresponding closely to said sloped faces of said guide rollers.

5. In a device as defined in claim 4, wherein said left and right longitudinal guides each have a respective adjusting means for setting a precise guide position in a direction which is oriented transversely to a predetermined plane.

6. In a device as defined in claim 1, wherein said rotor means has three pockets, two of said three pockets being disposed symmetrically on either side of a predetermined plane when in a stationary rotor position, wherein selectively one of said two pockets serves to eject cases.

7. In a device as defined in claim 6, wherein said two pockets are each respectively associated with one of a pair of forwardly oriented ejection chutes which are disposed outside of said rotor means.

8. In a device as defined in claim 7, further comprising a slide means having two arms, said slide means being displaceable in a direction transversely to said predetermined plane, one of said arms releasing a path for ejection of a cartridge into one of said ejection chutes while the other one of said arms blocks a passage to the other one of said ejection chutes, said other one of said arms constituting a frontal delimiting wall for a cartridge to be introduced into one of said plurality of rotor pockets.

9. In a device as defined in claim 1, further comprising a drive shaft means for rotating said case pusher means, said case pusher means being mounted on said drive shaft means for rotation therewith, said drive shaft means being disposed centrally within said rotor means.

10. In a device as defined in claim 9, wherein said case pusher means includes a bearing housing having a bearing means in its interior adapted to receive said drive shaft means for rotation therewith, said bearing means permitting longitudinal displacement of said case pusher means along said drive shaft means.

11. In a device as defined in claim 14, wherein, to accommodate said case pusher means, said rotor means has a longitudinal bore which is closely adapted to receive the outer contours of said bearing housing.

12. In a device as defined in claim 11, wherein each of said carrier elements are respectively connected with said bearing housing by respective webs.

13. In a device as defined in claim 12, wherein a plurality of longitudinal slits are respectively disposed between said bore of said rotor means and each of said plurality of rotor pockets, each of said longitudinal slits being adapted to closely receive the thickness of each of said plurality of webs of said case pusher means so as to slidingly accommodate respective ones of said webs.

14. In a device as defined in claim 10, wherein each of said plurality of carrier elements of said case pusher means projecting radially into every rotor pocket has a carrier surface for contacting said case and each of said plurality of carrier elements is connected with said bearing housing.

15. In a device as defined in claim 14, wherein said breechblock has a circumferential groove therein, and wherein said connecting means comprises a plurality of carrier springs which are disposed about said bearing housing at locations corresponding to each of said carrier elements for selective disposition with said circumferential groove.

16. In a device as defined in claim 15, wherein said circumferential groove has a depth which corresponds to a radius of a path of rotational travel of said plurality of carrier springs.

17. In a device as defined in claim 15, wherein said circumferential groove has a length along said breechblock, said carrier spring has a width, and further comprising a plurality of gaps having respective gap widths disposed between adjacent ones of said plurality of carrier springs, said length of said circumferential groove along said breechblock being greater than said respective gap widths.

* * * * *